US006347973B1

(12) United States Patent
Grant, III et al.

(10) Patent No.: US 6,347,973 B1
(45) Date of Patent: Feb. 19, 2002

(54) STICK-PROPELLED LOOP GAME

(76) Inventors: Robert Ray Grant, III, 160 Silver St., Greenfield, MA (US) 01301; Daniel Albert Manson; Brian Michael Polan, both of 175 Russell St., Sunderland, MA (US) 01375

( * ) Notice: Subject to any disclaimer, the term of this patent is extended or adjusted under 35 U.S.C. 154(b) by 0 days.

(21) Appl. No.: 09/138,901

(22) Filed: Aug. 4, 1998

Related U.S. Application Data

(63) Continuation-in-part of application No. 08/617,213, filed on Mar. 18, 1996, now abandoned.

(51) Int. Cl.[7] ..... A63H 33/02
(52) U.S. Cl. ..... 446/450; 473/514
(58) Field of Search ..... 446/431, 450; 473/505, 514, 588, 589, 569, 600, 601, 602, 516

(56) References Cited

U.S. PATENT DOCUMENTS

| | | | | | |
|---|---|---|---|---|---|
| 429,531 | A | | 6/1890 | Johnstone | 473/514 |
| 1,489,550 | A | | 4/1924 | Shaffer | 446/453 |
| 1,529,851 | A | | 3/1925 | Smithson | 273/96 B |
| 1,662,278 | A | | 3/1928 | Nelson | 437/514 |
| 1,922,578 | A | | 8/1933 | Fernandez | 273/126 R |
| 2,690,339 | A | | 9/1954 | Hall | 273/96 B |
| 2,953,378 | A | | 9/1960 | Veigne, Jr. | |
| D190,590 | S | | 6/1961 | Masse | |
| 3,176,673 | A | * | 4/1965 | Dill | 473/514 |
| 3,575,414 | A | | 4/1971 | O'Brien | 473/514 |
| 3,659,849 | A | | 5/1972 | Seymour | 473/514 |
| 3,823,942 | A | * | 7/1974 | Duncan | 473/514 |
| D247,687 | S | | 4/1978 | Roland | |
| D249,727 | S | | 9/1978 | Soos | |
| 4,118,030 | A | | 10/1978 | Randon | 473/505 |
| 4,173,841 | A | | 11/1979 | Hensley | 446/453 |
| 4,174,834 | A | | 11/1979 | DeMartino | 473/514 |
| 4,915,661 | A | | 4/1990 | Getgey | 273/425 |
| 5,154,430 | A | * | 10/1992 | Cozzolino | 473/514 |
| 5,330,381 | A | | 7/1994 | Hutcheson | 446/450 |

FOREIGN PATENT DOCUMENTS

| | | | |
|---|---|---|---|
| WO | 9734674 | * | 9/1997 |

* cited by examiner

*Primary Examiner*—Jacob K. Ackun, Jr.
*Assistant Examiner*—Faye Francis
(74) *Attorney, Agent, or Firm*—John C. Serio

(57) ABSTRACT

A stick-propelled loop game is presented. Fundamentally, the invention includes an annular loop characterized by a central opening therein. The loop is caused to fly through the air or bounce against the ground and is retrieved therefrom by means of a stick fashioned with a bulbous knob at the end which is insertable into the opening. The knob on the stick allows the player of the game to spin the loop while in his possession utilizing the centrifugal force of the loop against the stick. The central opening and the outside circumference of the loop are formed of a rubber like substance applied over a flexible material, such as plastic tubing. These materials allow the loop to possess sufficient mass and flexibility to allow the loop to be propelled through the air or bounced against the ground.

7 Claims, 3 Drawing Sheets

STICK-PROPELLED LOOP GAME

RELATED FILINGS

This is a continuation in part application. The original application, Ser. No. 08/617,213 now abandoned, was filed on Mar. 18, 1996, entitle tick-Propelled Loop Game, Art Unit 3301. An International Application on the parent application was filed on Mar. 13, 1997, International Application No. PCT/US97/03921.

BACKGROUND OF THE INVENTION

Heretofore it has been popular to use disks, saucers and balls as throwing objects in games of skill as a recreational pastime. A game known as "Ring Toss" has been known wherein a doughnutshaped rubber object is tossed from player to player. In addition, various means of throwing and retrieving a disk or a ring by means other than a player's hand have been developed through the years in order to add additional dimensions to the propelling and retrieving of various disks. The skill of tossing and retrieving a "disk" with a stick as disclosed in U.S. Pat. No. 4,174,834 or that of tossing and retrieving a flying disk by means of a catcher as disclosed in U.S. Pat. 2,690,339 or the tossing and retrieving of a ring as disclosed in U.S. Pat. No. 1,529,851 have been enjoyed by people for years. Additionally, tossing and retrieving a "Flying Saucer" by hand as disclosed in U.S. Pat. No. 3,359,678 has been enjoyed by a wide variety of people. However, in known game devices of this nature, the distance of travel and the aerodynamics of the device have been the most important aspects. In the devices used to propel the projectile the sole purpose of the catcher or foil has been to propel and retrieve and no manipulation of the projectile while in the possession of the player has been the object of the aforementioned inventions. Additionally, in the above inventions the propelled devices enjoy limited field of play where the instant invention can be played on a multitude of surfaces and through the air. Furthermore, in such known devices, the projectile is released and retrieved by the user's hand or with a simple stick held by the user. In addition, the field of play is through the air not involving the projectile having any qualities that would allow contact with the ground.

OBJECTS OF THE INVENTION

In light of the popularity of such game devices and the aforementioned shortcomings in the prior art, it is an object of the instant invention to provide a loop game which is stick-propelled. The aforementioned loop having specific features giving it flexible but firm playability that allows game players to propel the aforementioned loop through the air or against any solid surfaces. The within invention can be played by a single player against a solid surface or up to as many players as the participants desire. When multiple players are engaged in the sport of Loopa the features of the loop allow opposing players to pass the aforementioned loop through the air or by careening it off solid surfaces. When retrieved by the opposing player with a stick that is fashioned with a knob it allows the opposing player to both retrieve the oncoming loop and manipulate it in a way that allows the various players to both carry the spinning loop through the field of play and to engage the loop in a way that is pleasing to spectators of the sport of Loopa. Furthermore, the specifications of the loop allow it to be maintained in a spinning motion by the receiving player taking advantage of the centrifugal force of the spinning loop against the knob portion of the receiving stick.

It is a further object of the invention to provide a loop game which is stick propelled and includes a flexible loop constructed in a manner that provides players with a loop that has sufficient mass and firmness to allow it to be propelled at great distances through the air or upon and off hard surfaces but yet has characteristics in its construction that make it soft and pliable taking into account the safety of the game participants.

Yet another object of the invention is to provide a loop game wherein the loop is constructed in a manner that allows it sufficient firmness, flexibility, and buoyancy so that the loop may be propelled and retrieved while the participants are engaged in a field of play that includes water. The stick utilized with the loop game is designed to allow the players to propel and retrieve the loop and also allows the player to spin the loop once retrieved and prior to returning.

Still a further object of the invention is to provide a loop game which is stick-propelled, is simplistic in nature, readily adaptable to testing the physical skill of both young and old, and easily and durably constructed.

SUMMARY OF THE INVENTION

The foregoing objects and other objects which will become apparent as the detailed description proceeds are achieved by a loop game, comprising; an annular flexible loop having an opening centrally located within said loop; and at least one stick having a knob at its end for engagement with said opening and allowing the aforementioned loop to spin in a circular manner utilizing the centrifugal force of the loop against the knob of said stick and for propelling through the air and against the ground and retrieving said loop.

DESCRIPTION OF THE DRAWINGS

For a complete understanding of the objects, techniques, and structure of the invention, reference should be made to the following detailed description and accompanying drawing wherein.

DETAILED DESCRIPTION OF THE PREFERRED EMBODIMENT

Figure 1:
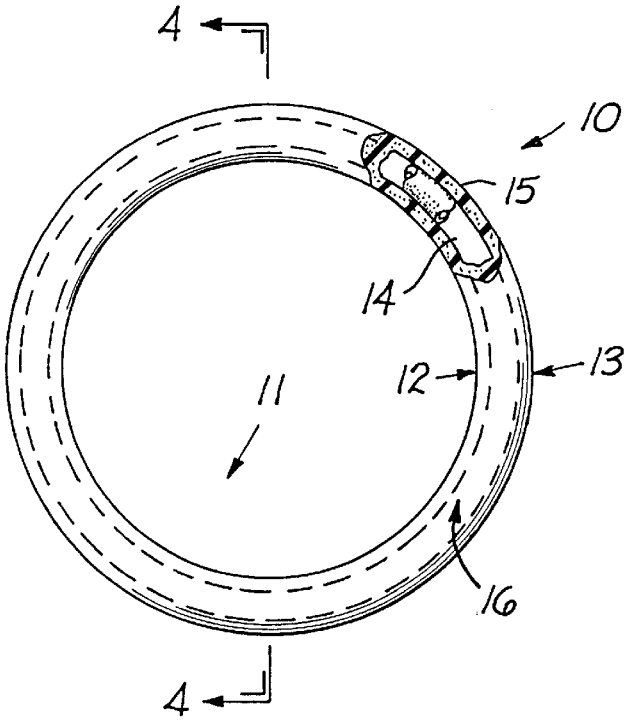
FIG. 1 is a top plan view of the annular loop portion of the invention.

Referring now to the drawing and more particularly to FIG. 1, it can be seen that a portion of the invention comprises a loop 10, which is of an annular nature. An inner opening 11 is defined by an inner circumferential edge 12. While the opening 11 and the inner edge 12 may vary somewhat with respect to the dimensional relationship, it is preferable that the inside diameter of the inner edge 12 be approximately 78 percent of the outside diameter 13 of the outer circumferential edge thereof. In one embodiment of the invention, the inside diameter of the inner edge 12 is 14 inches while the outside diameter of the outer edge 13 thereof is 18 inches. It has been found that by utilizing such proportionate dimensions the opening 11 is sufficiently large to accommodate the sticks 20 to be discussed hereinafter, while the distance from the inner edge 12 to the outer edge 13 is of sufficient mass to enable the loop 10 to fly through the air and bounce against the ground.

Figure 5:
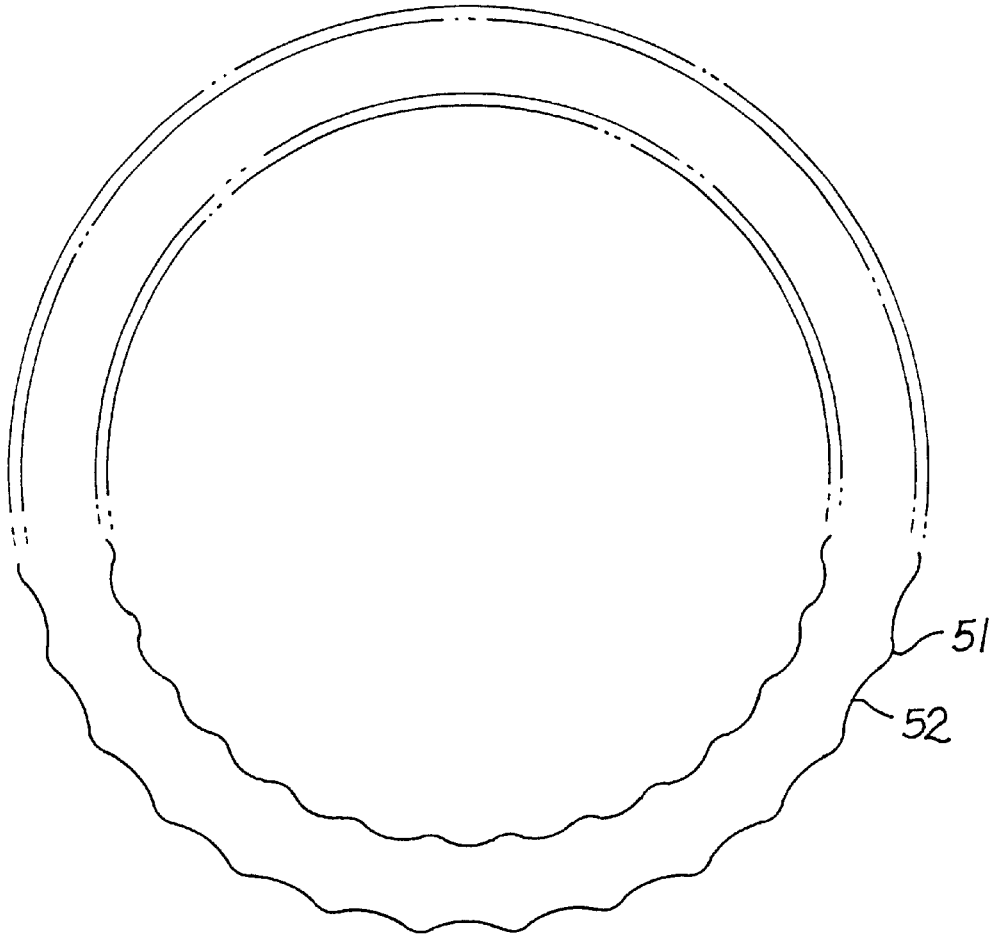
FIG. 5 is a side view of a version of the loop that contains ridges and valleys allowing a method of play in which the loop has greater traction against the surfaces with which the loop would come in contact.

While the loop 10 may be comprised of various suitable materials, one preferred embodiment of construction is an inner core 14 of a sturdy plastic tubing and a secondary layer 15 composed of a rubberized material such as foam rubber. The aforementioned inner core 14 imparts to the loop 10 a rigid core that is somewhat flexible but allows the loop 10 to retain its annular nature. The secondary layer 15 imparts a flexible, soft layer that gives the loop 10 mass and bounceability. The two aforementioned layers are covered with a protective membrane 16 to bind and protect the inner components of the loop 10. The outer surface of this protective membrane 16 may be fashioned from a commercially available cloth tape which is wound over the secondary layer 15 to protect the inner components of the loop 10. Another embodiment of the invention utilizes a latex material with rubberlike qualities that is applied in a uniform fashion over the secondary layer 15 forming a thin rubberized coating to protect the inner layers of the loop 10. Many different latex products can be used but in one embodiment a commercially available product known as Rubberizelt made by DIY Products of Chicago, Illinois was utilized. Additionally, the secondary layer 15 and outer layer 16 can be achieved by one layer when utilizing light weight low density poly vinyl chloride close cell foam which is an extruded close cell foam made by Rubatex Corporation of Roanoke, Virginia. The particular Rubatex product utilized was Rubatex Product Code 700. It has a density range of 6 to 9 pcf and a tensile strength of 50 psi. By using this particular embodiment the loop 10 has characteristics of flexibilty and firmness and a manufacturing step is saved by the use of a product such as Rubatex as it is manufactured in a manner that produces a nonporous outer coating. In reference to FIG. 5 which shows the aforementioned loop 10 having a secondary layer 15 which has an outer circumferential edge that is not smooth in nature but rather has ridges 51 and valleys 52 as shown in FIG. 5 that imparts to the loop 10 a tread-like appearance that allows the players greater friction against smooth surfaces. This secondary layer 15 that contains ridges 51 and valleys 52 is coated with an outer membrane such as the latex coating as mentioned above.

Figure 6:
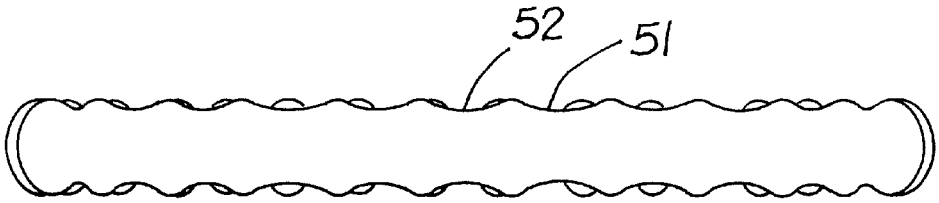
FIG. 6 is a top view of the loop that contains ridges and valleys allowing greater traction against surfaces on which it is played.

FIG. 6 shows a top view of the loop 10 exhibiting the ridges 51 and valleys 52 as shown in FIG. 5.

Figure 7:
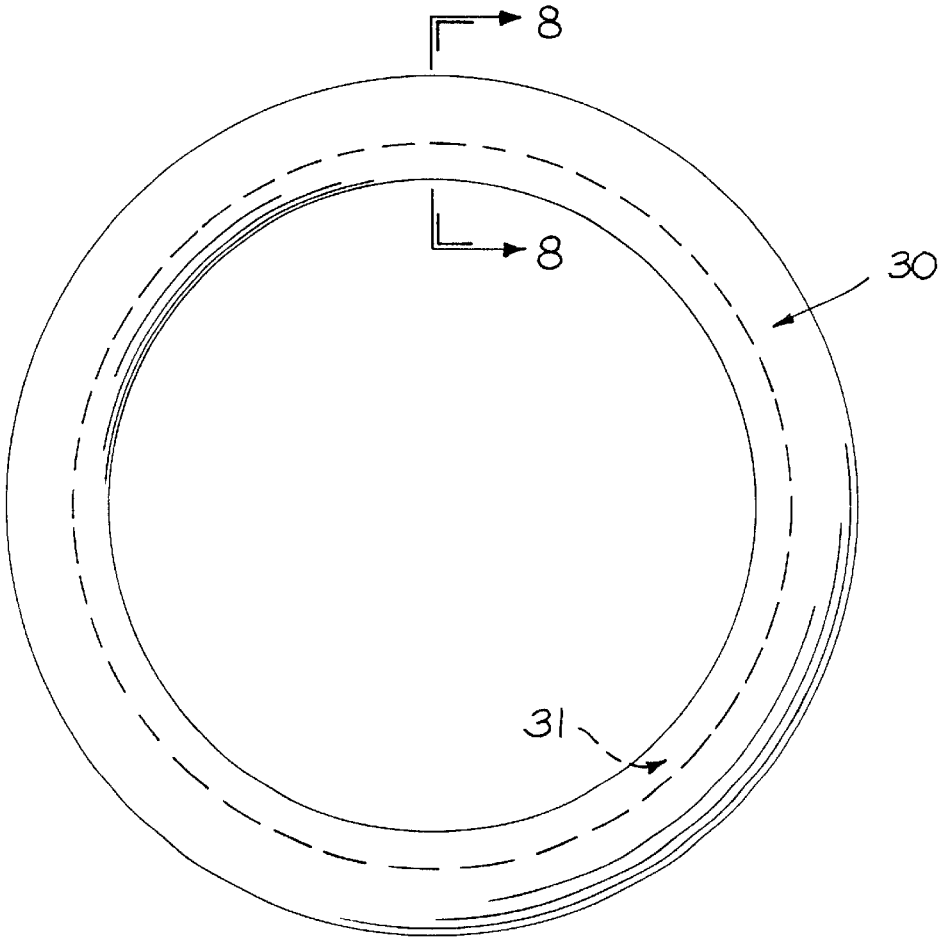
FIG. 7 is a side view of the loop made of ethylene vinyl acetate foam.

A third embodiment of the invention as shown in FIG. 7 utilizes an injection molded ethylene vinyl acetate foam with a density of approximately 2 pcf. This light weight and durable foam is commercially available in injection molded form from United Foam Products (UFP) Technologies of Georgetown, Massachusetts. This embodiment eliminates a three layer loop 10 and allows the loop 10 to have no inner core 14 or secondary core 15 or protective covering 16 but rather utilizes the properties of the injected molded ethylene acetate foam which imparts the bounceability, flexibility and rigidness of the three layer construction but sets forth a more durable loop 10 that has the playability of the three part loop 10.

Figure 8:
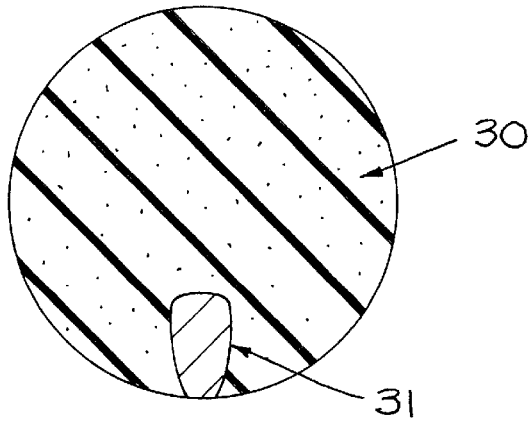
FIG. 8 is a cross section of the ethylene vinyl acetate foam loop showing the inner rim made of higher density ethylene vinyl acetate foam.

The aforementioned coreless loop 10 because of the ethylene acetate construction set forth a loop 10 which is safer when the aforementioned game is played by younger players. In FIG. 7 the ethylene acetate loop 30 can be reinforced with an inner rim 31 made of a higher density vinyl ethylene acetate. FIG. 8 shows a cross-section of the poly vinyl acetate loop 30 which shows an inner rim 31 that is comprised of the higher density poly vinyl acetate foam.

Figure 2:
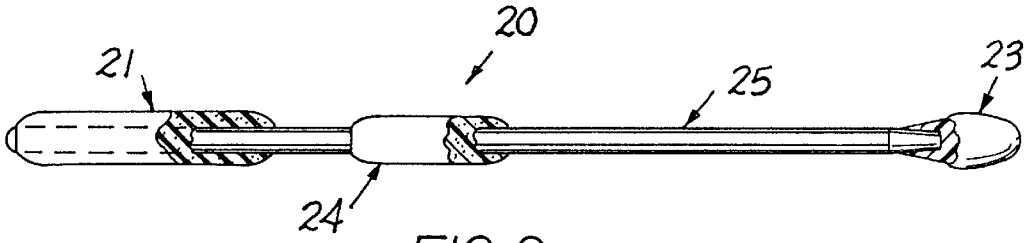
FIG. 2 is a top plan view of the stick utilized with the annular loop of FIG. 1 for propelling, retrieving and spinning such loop.
Figure 3:
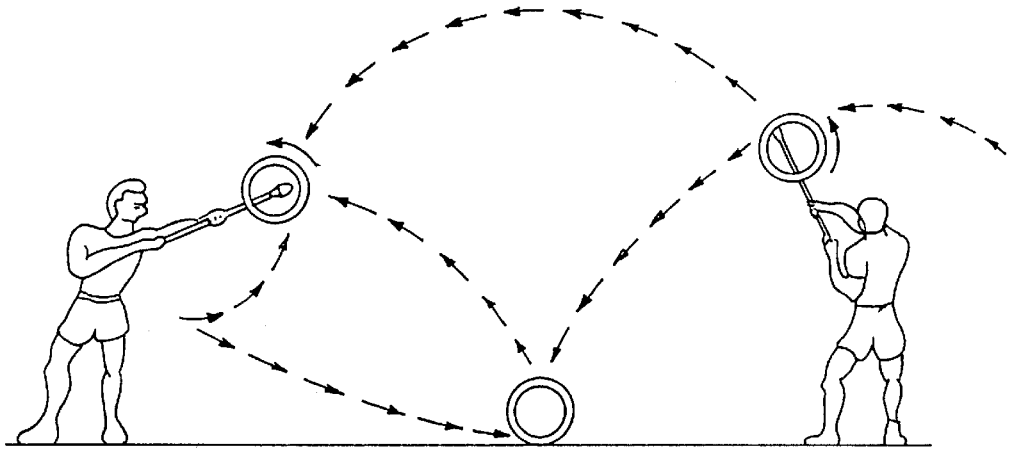
FIG. 3 is a pictorial illustration of the method of play that can be achieved with the stick and loop and shown in FIG. 1 and FIG. 2.

With reference to FIG. 2, it can be seen that a portion of the stick-propelled loop game comprising one or more sticks 20 which may be of any suitable length but which are preferably fashioned from a shaft 25 about 3 feet long having a diameter of 1-½ inches at the handle 21 and having an additional secondary handgrip 24 separated from the first handgrip 21 by approximately three inches and having a knob 23 at the opposite end of the shaft. The knob 23 is shaped in a way to contain the aforementioned loop 10 in a spinning centrifugal manner.

The shaft 25 of the sticks 20 may be of wood, plastic or graphite construction. The knob 23 may be constructed of wood or plastic and may be fashioned in a such a manner that it is removable from the shaft 25 of the stick 20. This removable feature can be achieved by the stick 20 possessing a male threaded end and the knob 23 possessing a female threaded core, or the stick 20 having a male end and the knob 23 having a female core being fastened together with a waterproof wood glue. The handle 21 and the secondary handgrip 24 may be fabricated of a compressed rubberized material such as neoprene or may be fabricated out of a cloth tape.

Figure 4:
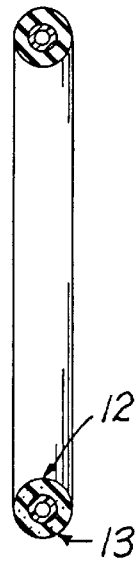
FIG. 4 is a cut-away view of the annular loop portion of the invention.

With reference to FIG. 4 which is a cut-away view of the loop 10, it can be seen that the inner circumferential edge 12 and the outer circumferential edge 13 are joined to form a circle.

In use, two or more players, each having a stick 20, propel the loop 10 between them while attempting to maneuver and manipulate the loop 10 in a spinning centrifugal manner with the stick 20. The player begins by placing the knob 23 portion of the stick 20 through the inner opening 11 of the loop 10. With the loop 10 and stick 20 so engaged, the user moves the stick 20 in a circular manner so as to take advantage of the centrifugal force of the loop 10 upon the stick 20. With the loop 10 and stick 20 so engaged, the user flings or whips the stick 20 to disengage the loop 10 therefrom and causes the loop 10 to fly through the air or against the ground toward the other player. The other player retrieves the loop 10 by catching same on his stick 20 by spearing or thrusting his stick 20 into the inner opening 11 of the loop 10. This player then engages the stick 20 in a circular motion to cause the loop 10 to spin around against the knob 23 of his stick 20. The player then returns the loop 10 to the first player by similarly flinging or whipping the stick 20 by the appropriate wrist and arm action. It will become readily apparent to the users of the game that significant skill can be developed such that certain wrist actions will make the loop 10 spin, while others will make the loop 10 soar through the air or bounce against the ground to the other player or players engaged in this game. In any event numerous game and scoring techniques can be devised by the users to judge or determine their relative skill if they so desire.

Thus it can be seen that the objects of the invention have been achieved by the structure presented above. While in accordance with the patent statutes, only the best mode and preferred embodiment of the invention has been presented and described in detail it is to be understood that the invention is not limited thereto or thereby. Consequently, for an appreciation of the true scope and breadth of the invention, reference should be had to the following claims.

What is claimed is:

1. A stick-propelled loop game comprising:

an annular loop having an opening centrally located within said annular loop, said annular loop having an inner circumferential edge about said opening having rounded edges;

an outer circumferential edge about the outside circumference of said annular loop having rounded edges forming a round ring; wherein said inner circumferential edge is of a diameter approximately equal to seventy-eight percent of the diameter of said outer circumferential edge;

said annular loop having an inner core of lightweight sturdy plastic tubing and a secondary layer cover said inner core and a membrane covering said secondary layer;

said secondary layer being comprised of a rubberized material, wherein said annular loop is buoyant over a surface of water yet bounceable over solid surfaces; and at least one stick for engagement with said opening for propelling said annular loop through the air and against solid surfaces and for retrieving said loop.

2. The stick-propelled loop game according to claim 1 wherein said stick comprises:

a shaft, wherein said shaft being of a consistent diameter;

a first handle located at one end of said shaft;

a second handle located above said first handle;

and a bulbous knob having a distal end and a proximal end, wherein said knob is located at the opposite end of said shaft from said handles, wherein said bulbous knob has a channel to retain said loop in a spinning manner or to propel said loop through the air.

3. The stick-propelled loop game according to claim 1 wherein said membrane is fabricated from latex.

4. The stick propelled loop game according to claim 1 wherein said outer circumferential edge of said loop possesses ridges and valleys and said ridges and valleys impart upon said loop traction on a variety of surfaces.

5. The stick-propelled loop game according to claim 2 wherein said shaft is fabricated from graphite.

6. The stick-propelled loop game according to claim 2 wherein said shaft and said bulbous knob is fabricated from plastic.

7. The stick-propelled loop game according to claim 2 wherein said bulbous knob is demountably attached to said shaft;

said knob having a female threaded core and said shaft having a male threaded core.

* * * * *